United States Patent [19]

Roscoe et al.

[11] 4,083,759

[45] Apr. 11, 1978

[54] METHOD FOR REDUCING SLUDGE FORMATION IN THE CONTINUOUS PRODUCTION OF IRON BY ELECTROLYSIS OF FERROUS ELECTROLYTE

[75] Inventors: Colin Roscoe, Mold, Wales; Kevin Lucas, Widnes, England

[73] Assignee: The Electricity Council, London, England

[21] Appl. No.: 705,980

[22] Filed: Jul. 16, 1976

[30] Foreign Application Priority Data

Jul. 17, 1975 United Kingdom ..... 30080/75

[51] Int. Cl.[2] ..... C25C 1/06; C25D 1/04

[52] U.S. Cl. ..... 204/112; 204/13; 204/236

[58] Field of Search ..... 204/239, 236, 241, 112, 204/3, 4, 13

[56] References Cited

U.S. PATENT DOCUMENTS

| | | | |
|---|---|---|---|
| 1,023,545 | 4/1912 | Bates et al. | 204/236 |
| 2,480,156 | 8/1949 | Matson et al. | 204/236 |
| 3,118,826 | 1/1964 | Smith | 204/239 |

*Primary Examiner*—T. M. Tufariello

*Attorney, Agent, or Firm*—Beveridge, DeGrandi, Kline & Lunsford

[57] ABSTRACT

Sludge formation is reduced in the continuous production of iron by electrolysis of a ferrous electrolyte in a electrodeposition cell by cooling spent electrolyte returning to a holding or regeneration tank, and heating reconstituted electrolyte returning to the electrodeposition cell. By reducing the temperature of the spent electrolyte the rate of hydrolysis of ferric ions to form oxides of iron, called sludge, is reduced, thus increasing the interval between periodic cleaning of the electrolyte regeneration system and the electrodeposition cell. In preferred forms of the invention heat energy is transferred from the spent electrolyte to the reconstituted electrolyte by means of at least one counter flow heat exchanger in the form of a hollow cylinder containing a plurality of tubes made of titanium. There may be a controllable cooling device disposed between the holding tank and the or the last heat exchanger for maintaining the temperature of electrolyte in the holding tank at a selected value.

10 Claims, 5 Drawing Figures

METHOD FOR REDUCING SLUDGE FORMATION IN THE CONTINUOUS PRODUCTION OF IRON BY ELECTROLYSIS OF FERROUS ELECTROLYTE

BACKGROUND OF THE INVENTION

This invention relates to the continuous production of iron at the cathode of an electrode-position cell continuously fed from a holding or regeneration tank with electrolyte bearing ferrous ions. The predominant reaction occurring at the anode yields ferric ions which are carried away from the cell in the electrolyte returning to the holding tank. Besides holding, at any one instant, in the region of 90% of the total electrolyte volume, this tank is fed with metallic iron which serves to convert the ferric ions back to ferrous ions thereby reconstituting, i.e. regenerating, the electrolyte.

The electrolyte is preferably at an elevated temperature in order that the deposited iron is ductile. This is particularly important in the case where iron is continuously stripped from the cathode as foil; ductility is a desirable attribute or characteristic of a metal foil. This production of foil, which when stripped from the cathode displays sufficient ductility to render annealing unnecessary, requires an electrolyte temperature typically in the region of 95° C. At such high electrolyte temperatures the rate of hydrolysis of ferric ions, in the pH region 0.3 to 1.4 which is that normally adopted for the electrodeposition of ductile iron foil, to form oxides of iron, termed sludge, is such that the sludge interferes with the smooth-running operation of the deposition apparatus. The problem is further compounded since for the production of foil on a commercially viable basis, passage of a very high current is required in the deposition cell. This in turn gives rise to a correspondingly large heating effect and consequently the temperature of electrolyte leaving the cell is appreciably higher than the temperature of electrolyte entering the cell.

SUMMARY

According to one aspect of the present invention there is provided a method of continuous production of iron by electrolysis of a ferrous electrolyte in an electrodeposition cell, wherein the ferrous electrolyte is reconstituted by the steps of cooling the electrolyte leaving the electrodeposition cell, passing the cooled electrolyte into a holding tank containing metallic iron to reconstitute ferrous ions in the electrolyte and heating the reconstituted electrolyte after it has left the tank but prior to its entry into the cell.

The rate of sludge formation reduces as the electrolyte temperature is reduced, and from this standpoint the lower the temperature at which the electrolyte is held in the holding tank the better. However, there are other factors which have to be taken into consideration, namely, the rate of ferrous ion reconstitution and the cost of cooling and heating. In practice it is unlikely that temperatures below 75° C would be considered. Indeed under certain circumstances the rates of sludge formation at somewhat higher temperatures could be tolerated. In this respect it is helpful if the pH is maintained at the bottom end of the prescribed range. However, if the pH is too low there is an undesirable lowering of cathode current efficiency. In consideration of these two contradictory requirements, the optimum value of pH, as measured at 25° C would lie in the range 0.4 to 0.7 units.

In those cases where the electrodeposition cell consists of a rotating drum cathode and conforming anode, it is advantageous to introduce electrolyte from the heating means to the bottom of the cell so that foil is nucleated from electrolyte about to flow out of the deposition cell, i.e. from electrolyte at its maximum temperature. It will be appreciated that under these conditions the electrolyte can be allowed to issue from the heating means at a slightly lower temperature as compared with the electrolyte temperature selected for the deposition of a ductile foil under conditions where electrolyte is introduced to the cell at the point or zone of nucleation or where the electrolyte temperature remains invariant during deposition. Under these circumstances the temperature of the electrolyte in the holding tank can be maintained at a correspondingly lower temperature.

According to another aspect of the present invention there is provided a regeneration system in or for use in an electrodeposition apparatus for continuous production of iron by electrolysis in an electrode-position cell of a ferrous electrolyte, which regeneration system comprises a holding tank in which in use ferric ions in the electrolyte returning from the cell are reconstituted to ferrous ions by contact with metallic iron, means arranged to cool returning electrolyte during its passage from the electrodeposition cell to the holding tank, and means arranged to heat reconstituted electrolyte during its passage from the holding tank to the electrodeposition cell. Preferably the cooling means is arranged adjacent the electrolyte outlet of the electrodeposition cell in order to reduce the length of pipework through which the hot electrolyte flows so reducing the amount of sludge formation and the heat loss. The heating means is preferably adjacent the inlet of the electrodeposition cell in order to reduce heat loss from the pipework carrying the electrolyte to the cell.

For a typical flow of $10m^3/h$, a power input of approximately 150 kW, from an external source, is required to raise the electrolyte temperature by 10° C. Consequently, it is preferable from economic considerations that the heating means and the cooling means are, at least in part, constituted by at least one counter flow heat exchange which exchanges heat between the returning electrolyte and the reconstituted electrolyte leaving the holding tank. This heat exchanger will present a high impedance to electrolyte flow because of the small diameter passages needed to obtain a good surface area to volume ratio. Consequently, the normal practice of allowing electrolyte to return from the cell to the holding tank under the action of gravity will, in most instances, be untenable. (In the normal practice, reconstituted electrolyte is pumped from the holding tank to the cell via a means for controlling the flow rate, which in this case would be disposed between the heat exchanger and the inlet manifold of the electrodeposition cell). To overcome this problem a pump, disposed between the outlet of the electrodeposition cell and the high temperature input of the heat exchanger, is required to develop the necessary input pressure. By way of protection, the pump may be fed with electrolyte returning from the cell via a relatively small (say $0.20m^3$) reservoir preferably fitted with a constant level device. As will be apparent, the use of a heat exchanger (or two or more arranged in series) of necessity requires that the temperature of reconstituted electrolyte being fed to the low temperature input of the heat exchanger is lower than the temperature of the electrolyte leaving the low temperature output of the heat exchanger. However, electrolyte must enter the holding tank at a higher temperature than the value chosen for the regeneration process in order to offset the standing heat losses from the tank; evaporation being a major contribution to these losses. Evaporation can be reduced considerably by reducing the electrolyte-air interfacial area by means e.g. of a layer of polypropylene balls. However, in the majority of instances it is more likely that too little heat will be lost from the holding tank, necessitating e.g. a relatively small electrolyte/water counter flow heat exchanger to be inserted between the low temperature output of the heat exchanger and the input to the holding tank. The warm water issuing from this heat exchanger can be utilized in e.g. the wash stations of the foil production plant. Alternatively air cooling can be employed and the warm exhaust air used e.g. to dry the foil.

DETAILED DESCRIPTION

Figure 1:
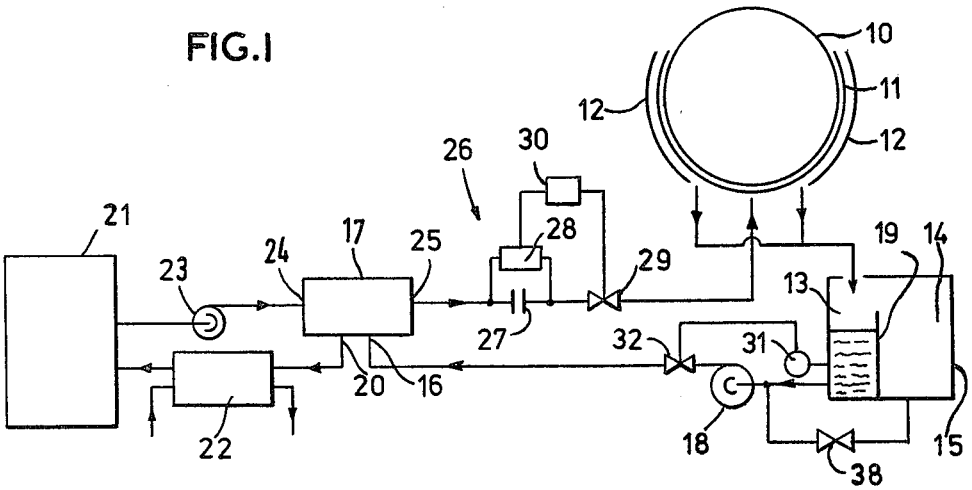
FIG. 1 is a schematic diagram of the electrolyte regeneration system of an electrodeposition cell.

In FIG. 1 there is shown an electrode-position cell comprising a drum cathode 10 having a titanium cylindrical surface, and a complementary arcuate anode 11 having a carbon electrochemically effective surface. A ferrous chloride electrolyte is fed to an inlet at the bottom of the anode. Electrolyte spills over the top of the anode and is contained by an outer shell 12 before passing into the smaller compartment 13 of the two compartments 13, 14 of a reservoir 15 which feeds a high temperature input 16 of a counter flow heat exchanger 17 via a pump 18 which raises the input pressure of the electrolyte so as to obtain a satisfactory flow rate through the heat exchanger 17. The two compartments are formed by means of a partition wall 19 in reservoir 15. The heat exchanger 17 is in the form of a cylindrical shell containing a plurality of titanium tubes. The cylindrical shell is formed of a glass reinforced plastics material; alternatively, it can be formed of titanium.

A low temperature output 20 of the heat exchanger 17 is fed into a holding or regeneration tank 21 containing metallic iron via a cooling device 22 in the form of a much smaller counter flow heat exchanger, which utilises a suitable coolant e.g. water or air. The flow rate of coolant through this heat exchanger 22 is adjusted so that the electrolyte temperature in the holding tank remains steady at the desired temperature. In the tank ferric ions in the spent electrolyte are converted to ferrous ions by reaction with the iron, thus reconstituting the ferrous chloride electrolyte. Reconstituted electrolyte from tank 21 is pumped by means of pump 23 to a low temperature input 24 of heat exchanger 17 and after leaving via a high temperature output 25 of heat exchanger 17 passes through a flow control means 26 and is then fed into the electrodeposition cell inlet.

The flow control means 26 comprises a flow rate sensor in the form of an orifice plate 27, a differential pressure sensor 28 for providing a pneumatic signal output in dependence upon the difference in pressures on opposite sides of orifice plate 27, a pneumatically operated valve 29 mounted downstream of the orifice plate 27 and responsive to an indicating flow controller 30 receiving the signal output of the differential pressure sensor 28.

The output from a pressure sensor 31 associated with compartment 13 is used to control a pneumatically operated valve 32 connected between pump 18 and low temperature input 16 so as to ensure a constant level of electrolyte in the smaller compartment 13 of reservoir 15. This arrangement acts as protection for pump 18.

In the arrangement of FIG. 1 the electrolyte leaves the high temperature output 25 and enters the electrodeposition cell at a temperature of 94° C. The pipes and flow control means between the heat exchanger and the cell will be thermally insulated so that there is insignificant heat loss.

For a deposition current of 50,000A and a flow rate of $10m^3/h$ the electrolyte leaves the electrode-position cell at a temperature of about 102° C. Reservoir 15, the heat exchanger 17 and pump 18 are all mounted close to the cell and thus for the purpose of explanation it will be assumed that the temperature of the electrolyte upon entering the heat exchanger 17 is 102° C. The heat exchanger 17 will operate under optimum conditions so that the temperature of the electrolyte leaving at the low temperature output 20 is equal to the temperature of electrolyte leaving at the high temperature output 25, namely 94° C. By assuming that the heat exchanger operates without heat loss to its surrounds, the heat loss by the returning electrolyte is the heat gained by the reconstituted electrolyte. Thus the temperature of electrolyte entering the low temperature input 24 is 86° C. This is thus the temperature at which the holding tank is kept: at this temperature there is significantly less sludge formed than at, say, 94° C, i.e. where the holding tank supplies the cell directly.

To further minimise sludge formation, whilst retaining a high cathode current efficiency (≧ 90%), the pH, as measured at 25° C is maintained within the range 0.4 to 0.7 pH units.

The returning electrolyte leaves the low temperature output 20 at a temperature of 94° C and enters heat exchanger 22 in which the electrolyte temperature is lowered so that a temperature of 86° C is maintained in the holding tank. Changes in conditions affecting the rate of heat loss from the holding tank, e.g. change in temperature of the surrounding atmosphere or change in the electrolyte-air interfacial area, can be accommodated by varying the flow of coolant through heat exchanger 22 in dependence with the sensed temperature of electrolyte in the holding tank, or leaving heat exchanger 22 in the manner shown in FIG. 4 in connection with cooling means 46.

By suitably selecting the holding tank design and/or its position relative to the heat exchanger 17 the rate of cooling required of heat exchanger 22 can be made zero, and thus the heat exchanger 22 can be omitted in this case.

Figure 2:
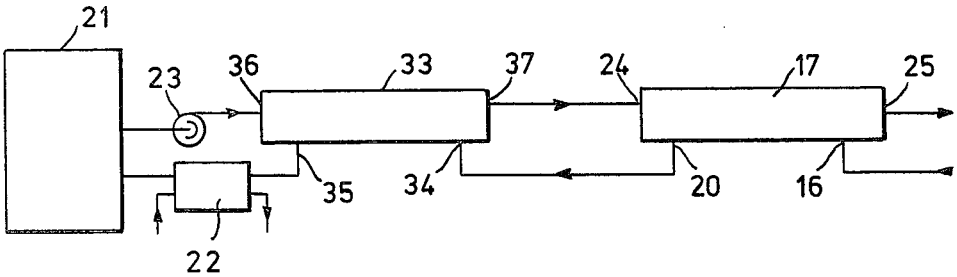
FIG. 2 is a schematic diagram of a modification of part of the system of FIG. 1.

FIG. 2 shows a modification of the arrangement of FIG. 1 which can be used where it is desired to operate the holding tank at 78° C. In this case a further counter flow heat exchanger 33 is disposed intermediate heat exchanger 17 and the holding tank 21. The low temperature output 20 feeds a high temperature input 34 of heat exchanger 33. A low temperature output 35 feeds the heat exchanger 22 which dumps the heat in excess of that required to maintain the desired temperature, 78° C, in the holding tank. The reconstituted electrolyte from tank 21 is fed to a low temperature input 36 of the heat exchanger 33 and low temperature input 24 of heat exchanger 17 is fed from a high temperature output 37 of heat exchanger 33. In this case returning electrolyte enters heat exchanger 33 at 94° C and leaves at 86° C, and reconstituted electrolyte enters at 78° C and leaves at 86° C.

Figure 3:
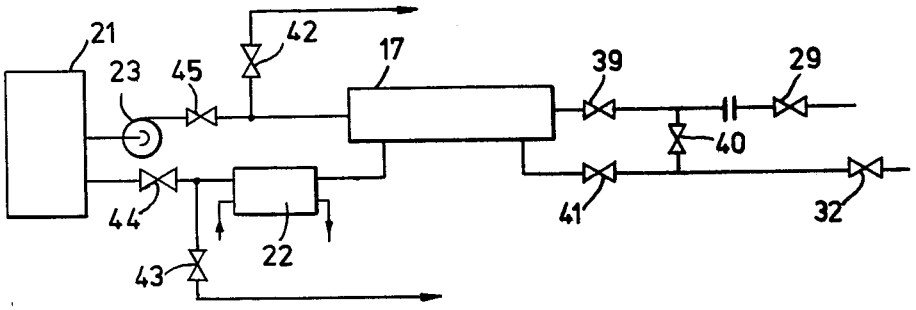
FIG. 3 is a schematic diagram of a part of FIG. 1 showing a modification to permit cleaning of the system.

By use of the method of the present invention the rate of sludge formation is reduced, but sludge formation is not stopped entirely and thus a benefit of the present invention is to increase the interval between periodic cleaning of the electrolyte regeneration system and the electrodeposition cell. It is preferred to perform this cleaning operation chemically by purging with hydrochloric acid. In order to perform such a chemical cleaning the arrangement of FIG. 1 can be provided with valves as shown in FIG. 3.

The electrolyte distribution system is first drained of electrolyte, valve 38 (see FIG. 1) connected between compartment 14 and pump 18 is opened and valve 32 is overriden so as to remain closed while both compartments 13, 14 of reservoir 15 are filled with hydrochloric acid. The acid is heated to at least 70° C by for example suitably sheathed immersion heaters in order to reduce the time required for dissolution of the sludge.

To clean the electrodeposition cell, if the material of the anode would not be attacked by the acid, valves 39 and 41 would be closed and valves 32, 40 and 29 would be open. The hot acid would then be pumped through the cell by means of pump 18, returning to the reservoir 15, the pressure sensor 31 (FIG. 1) being overriden so that the level in reservoir 15 is above the height of the partition wall 19.

The shell of heat exchanger 17 and the inside of the titanium tubes of the heat exchanger 22 can be cleaned by closing valves 40 and 44, opening valves 32, 41 and 43 and pumping the acid through the heat exchangers. The acid is returned to the inlet of reservoir 15 via valve 43. Once the acid is spent the contents of reservoir 15 can be pumped into the holding tank, by closing valve 43 and opening valve 44, thereby replacing chloride ions dragged out of the deposition cell by the emerging foil.

Similarly, the inside of the titanium tubes of the heat exchanger 17 can be cleaned by closing 41, 29 and 45, opening valves 32, 40, 39 and 42 and pumping the acid through the heat exchanger. Again the acid is returned to reservoir 15.

Acid can be injected into the holding tank by closing for example valves 40, 43, 39 and opening valves 32, 41 and 44.

Figure 4:
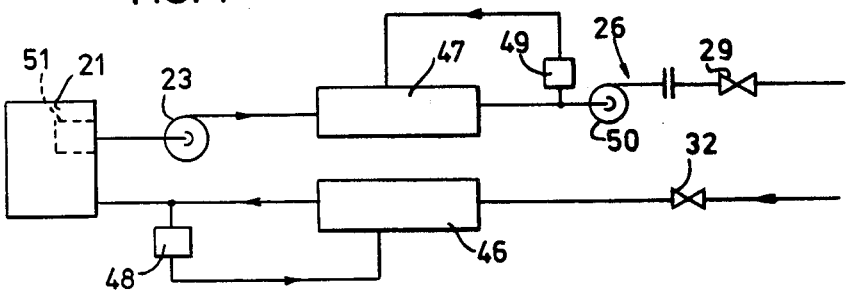
FIG. 4 is a schematic diagram of an alternative form of part of the system of FIG. 1.

Other forms of heating and cooling the electrolyte can be used. FIG. 4 shows a schematic arrangement where electrolyte returning to the holding tank is cooled by cooling means 46 and reconstituted electrolyte returning to the electrodeposition cell is heated by a heating means 47. The electrolyte is fed to the heating means 47 via a pump 23. In this example the holding tank input temperature is monitored by a temperature sensor 48 giving an output signal and the cooling means 46 may be responsive to this output signal to vary the amount of cooling so as to maintain a constant input temperature. Where cooling means 46 is a counter flow heat exchanger with the excess heat being transferred to water, the output signal of sensor 48 would, for example, control the flow rate of water.

Similarly, a temperature sensor 49 may be provided either before or after the flow control means 26 arranged to be responsive to the output of heating means 47 in order to provide control of the temperature of the electrolyte input to the electrodeposition cell. The heating means 47 conveniently comprises a relatively small tank in which heat is supplied to the electrolyte from a steam coil or immersion heaters. As shown in FIG. 4, this small tank is physically spaced from the holding tank 21, however, in an alternative arrangement it can be constituted by a small compartment, indicated by the dashed line 51, formed by a partition wall in a large tank with the remaining larger compartment constituting the holding tank 21. The volume of this relatively small tank would be chosen to reduce sludge formation to a minimum and would, together with the volume of the associated pipework and deposition cell ideally represent no more than 10% of the total electrolyte volume.

Figure 5:
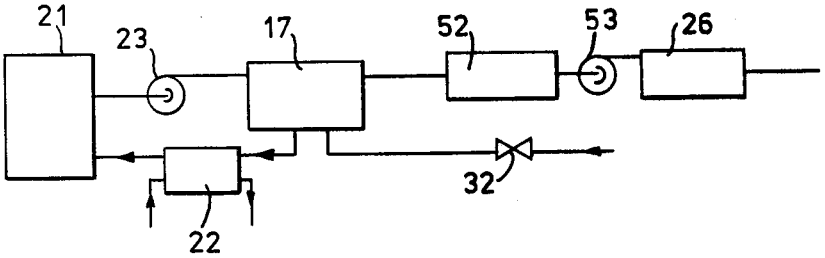
FIG. 5 is a schematic diagram of another modification of a part of the system of FIG. 1.

In FIG. 5 the heat imparted to the electrolyte in the counter flow heat exchanger 17 is augmented by a heating device 52 which can comprise a heated tank similar to heating means 47 of FIG. 4; a pump 53 follows such a heated tank to avoid gravity feeding to cell 10 from this tank. In this manner the electrolyte can leave the heat exchanger at, say, 90° C, pick up heat during passage through heating device 52 and enter the deposition cell at a temperature of 94° C. The electrolyte temperature in the holding tank can then be held at the correspondingly lower value of 82° C providing the appropriate amount of heat is extracted from the returning electrolyte in the cooling means 22.

It will be appreciated that prior to using the apparatus for the electrodeposition of iron foil the electrolyte temperature must be raised to a level suitable for the deposition of ductile foil. This can be achieved by, for example, a steam coil or immersion heaters placed in the holding tank 21, or preferably in a small tank adjacent the holding tank. This small tank can conveniently be formed in the same manner as tank 51 shown in dashed lines in FIG. 4. Alternatively, the electrolyte temperature can be raised for this purpose by the aforementioned heating means 47, or the heating device 52.

We claim:

1. In a method of continuous production of iron by electrolysis of a ferrous electrolyte in an electro-deposition cell, the improvement wherein the ferrous electrolyte is reconstituted by the steps of cooling the electrolyte leaving the electrodeposition cell, passing the cooled electrolyte into a holding tank containing metallic iron to reconstitute ferrous ions in the electrolyte, and heating the reconstituted electrolyte after it has left the tank but prior to its entry into the cell, to thereby reduce the rate of sludge formation in said method.

2. A method according to claim 1 wherein at least some of the heat removed from the electrolyte in the cooling step is utilized in the heating step.

3. A method according to claim 2 wherein returning electrolyte and reconstituted electrolyte flow in opposite directions through at least one counter flow heat exchanger.

4. A method according to claim 3 wherein the cooling step includes cooling the returning electrolyte after it has left said at least one heat exchanger and prior to its entry into the holding tank.

5. A method according to claim 4 wherein the cooling of the returning electrolyte after it has left said at least one heat exchanger is performed by a cooler controlled in dependence upon the sensed temperature of electrolyte in one of said holding tank and the flow to said holding tank from said controlled cooler.

6. A method according to claim 3 wherein the heating step includes heating the reconstituted electrolyte after it has left said at least one heat exchanger and prior to its entry into the electrodeposition cell.

7. A method according to claim 3 wherein the returning electrolyte passes from the electrodeposition cell to said at least one heat exchanger via a pumping means.

8. A method according to claim 1 wherein the pH of the electrolyte, as measured at 25° C, lies in the range 0.4 to 0.7.

9. A method according to claim 1 wherein in the electrodeposition cell electrolyte flows towards a nucleation zone of the cell, and wherein the reconstituted electrolyte is introduced into the cell at a selected temperature lower than that of electrolyte in the nucleation zone of the cell.

10. A method according to claim 5 wherein said cooler comprises a further couter-flow heat exchanger and means for controlling the flow rate of a counter-flowing coolant in dependence upon said sensed temperature.

* * * * *